US007909430B2

(12) United States Patent
Sakaida

(10) Patent No.: US 7,909,430 B2
(45) Date of Patent: Mar. 22, 2011

(54) LIQUID EJECTION APPARATUS AND WAX GAP SEALING MEMBER

(75) Inventor: Atsuo Sakaida, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 710 days.

(21) Appl. No.: 11/864,445

(22) Filed: Sep. 28, 2007

(65) Prior Publication Data

US 2008/0079771 A1 Apr. 3, 2008

(30) Foreign Application Priority Data

Sep. 29, 2006 (JP) ..... 2006-266475

(51) Int. Cl.
*B41J 2/165* (2006.01)

(52) U.S. Cl. ..... 347/33

(58) Field of Classification Search ..... 347/20, 347/22, 33, 40, 41, 42, 43, 45, 49
See application file for complete search history.

(56) References Cited

U.S. PATENT DOCUMENTS 6,045,216 A 4/2000 Sasaki
6,428,151 B1 * 8/2002 Yi et al. ..... 347/68
6,866,361 B2 3/2005 Kuki et al.
7,341,329 B2 3/2008 Takagi
2005/0068366 A1 3/2005 Takagi

FOREIGN PATENT DOCUMENTS

JP H06-155731 A 6/1994
JP H09-066607 A 3/1997
JP 2004142450 A 5/2004
JP 2005-103781 A 4/2005
WO 0119667 A1 3/2001

OTHER PUBLICATIONS

Paraffin wax. (2000). In Collins English Dictionary. Retrieved from http://www.credoreference.com/entry/hcengdict/paraffin_wax.*
Japanese Patent Office, Notice of Reasons for Rejection for Japanese Patent Application No. 2006-266475 (counterpart to above-captioned patent application), mailed Oct. 7, 2008.

* cited by examiner

*Primary Examiner* — An H Do
(74) *Attorney, Agent, or Firm* — Baker Botts L.L.P.

(57) ABSTRACT

A liquid ejection apparatus has liquid ejection heads. Each liquid ejection head has a liquid ejection surface, including nozzles, and a gap is formed between the liquid ejection heads. A sealing member is positioned in the gap, and the sealing member forms a surface. The sealing member joins the liquid ejection surface of a liquid ejection head to an adjacent liquid ejection surface of another liquid ejection head. A wiper wipes each liquid ejection surface and the surface formed by the sealing member.

9 Claims, 6 Drawing Sheets

LIQUID EJECTION APPARATUS AND WAX GAP SEALING MEMBER

CROSS REFERENCE TO RELATED APPLICATION

This application claims priority to and the benefit of Japanese Patent Application No. 2006-266475, filed Sep. 29, 2006, the entire subject matter and disclosure of which is incorporated herein by reference.

BACKGROUND OF THE INVENTION

1. Field of the Invention

The invention relates to a liquid ejection apparatus such as an inkjet printing apparatus having a plurality of inkjet heads configured to eject ink droplets.

2. Description of Related Art

A known inkjet printing apparatus includes four inkjet heads arranged adjacently to each other in a direction where a recording sheet is fed, e.g., a sheet feed direction, and a maintenance unit configured to perform maintenance of the inkjet heads. The maintenance unit includes a blade or wiper configured to wipe ink adhering to a nozzle surface, e.g., a liquid ejection surface of each inkjet head. When the maintenance unit is in a purge position, the heads are purged. While the maintenance unit moves from the purge position to a withdrawal position, ink adhering to the nozzle surface during purging is wiped by the blade, and maintenance of the inkjet heads is performed.

However, as the four inkjet heads are arranged only adjacently to each other in the inkjet printing apparatus, minute gaps are formed between the nozzle surfaces of the heads. When ink mist and airborne dust in the inkjet printing apparatus and ink adhering to the nozzle surfaces are collected by the blade, they spread in a direction perpendicular to a moving direction of the blade, and ester and remain in the gaps. Ink and foreign matter collected in the gaps may drop down from the gaps. If the in drops down front the gaps during printing, it may soil a recording sheet, and reduce print quality. In addition, if the ink is accumulated in the gaps, ink may be spread onto the nozzle surfaces when the nozzle surfaces are wiped by the blade, and the nozzle surfaces may be soiled, reducing print quality.

SUMMARY OF THE INVENTION

Aspects of the invention provide an inkjet printing apparatus configured to minimize foreign matter lodged between liquid ejection surfaces of a plurality of liquid ejection heads.

In an embodiment of the invention, a liquid ejection apparatus comprises a plurality of liquid ejection heads. Each liquid ejection head comprises a liquid ejection surface formed with a plurality of nozzles, and a particular gap is formed between the plurality of liquid ejection heads. A particular sealing member is disposed in the particular gap, and the particular sealing member forms a particular surface. The particular sealing member joins the liquid ejection surface of at least one of the plurality of liquid ejection heads to an adjacent liquid ejection surface of at least another of the plurality of liquid ejection heads and a wiper is configured to wipe each liquid ejection surface of the plurality of liquid ejection heads and the particular surface.

BRIEF DESCRIPTION OF THE DRAWINGS

Embodiments of the invention now are described with reference to the accompanying drawings, which are given by way of example only, and are not intended to limit the present invention.

DETAILED DESCRIPTION OF PREFERRED EMBODIMENTS

Preferred embodiments of the present invention, and their features and advantages, may be understood by referring to accompanying drawings, like numerals being used for corresponding parts in the various drawings.

Figure 1:
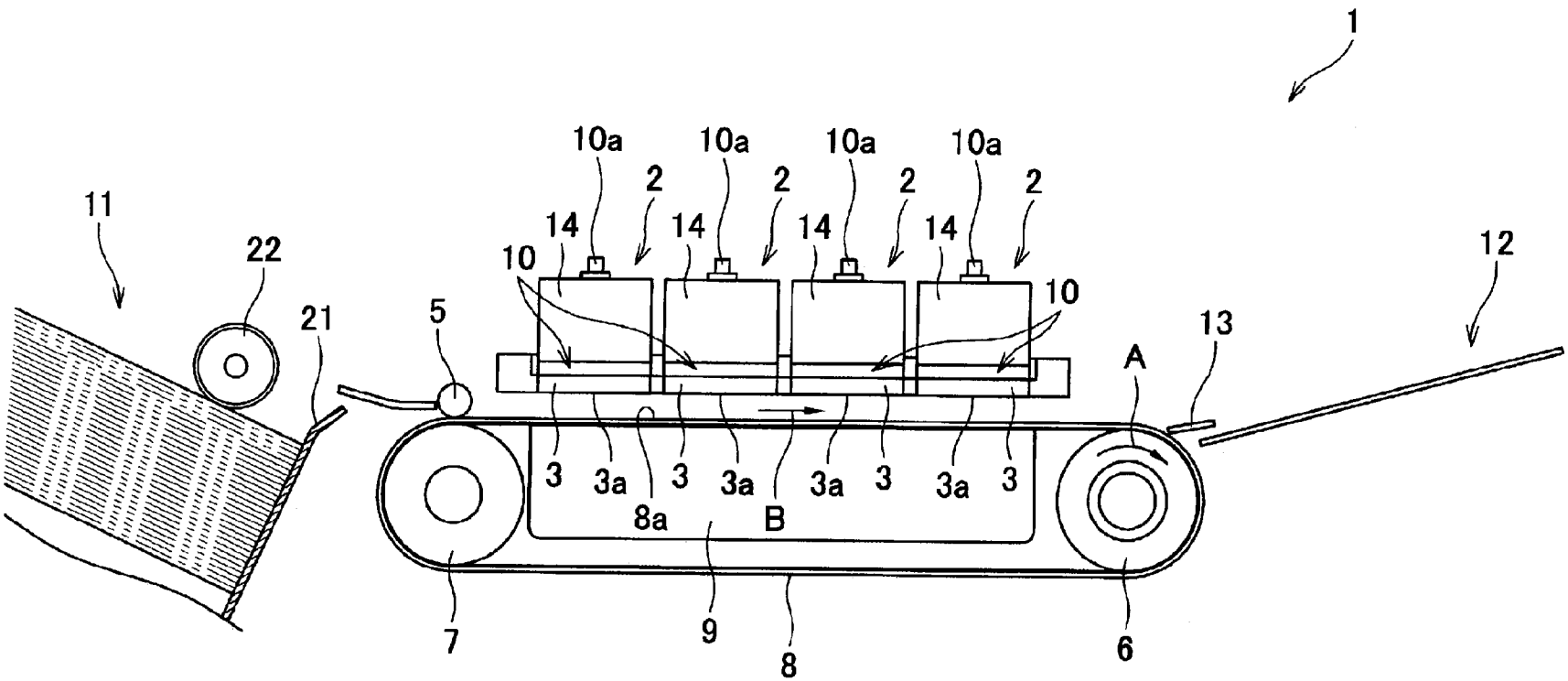
FIG. 1 is a schematic cross-sectional view of an inkjet printer according to an embodiment of the invention.

As shown in FIG. 1, a liquid ejection apparatus e.g., an inkjet printer 1 may be a color inkjet printer having a plurality of, e.g., four, liquid ejection heads, e.g., inkjet heads 2. Inkjet printer 1 may be provided with a sheet supply mechanism 11 and a sheet ejection portion 12. Inkjet printer 1 may be formed with a sheet feed path, in which a recording sheet may be fed from sheet supply mechanism 11 to sheet ejection portion 12. Sheet supply mechanism 11 may include a pickup roller 22 configured to pick up and feed an uppermost recording sheet of a stack of recording sheets stored in a sheet tray 21. The recording sheet nay be fed from left to right when inkjet printer 1 is positioned as shown in FIG. 1, by the pickup roller 22. Two belt rollers 6, 7, and an endless conveyor belt 8, stretched between the belt rollers 6, 7, may be disposed substantially in the sheet feed path. An outer surface of conveyor belt 8, or a feeding surface 8*a*, may be treated with a substance, e.g., silicon, to increase the adhesion of the outer surface.

A presser roller 5 may be positioned facing Y conveyer belt 8, directly downstream of sheet supply mechanism 11. Presser roller 5 may hold the recording sheet fed from the sheet supply mechanism 11, down to the feeding surface 8*a* of the conveyor belt 8. Thus, the recording sheet held down to feeding surface 8*a* may be fed to a downstream side, while being substantially adhered to feeding surface 8*a*. At this time, belt roller 6, disposed on a downstream side with respect to the sheet feed direction, may be driven by a drive force from a drive motor (not shown), causing belt roller 6 to rotate clockwise, e.g., in an arrow direction A in FIG. 1.

A separation member 13 may be disposed along the sheet feed direction, directly downstream of the conveyor belt 8. Separation member 13 may be configured to separate the recording sheet held by feeding surface 8*a* of conveyor belt 8 from feeding surface 8*a*, and feed the recording sheet to sheet ejection portion 12. A platen 9, having a substantially rectangular solid shape, may be disposed in an area enclosed by conveyor belt 8. Platen 9 may contact a lower surface of conveyor belt 8, at a position where an upper portion of conveyor belt 8 may face inkjet heads 2, supporting conveyor belt 8 from its inner circumferential side.

Figure 2:
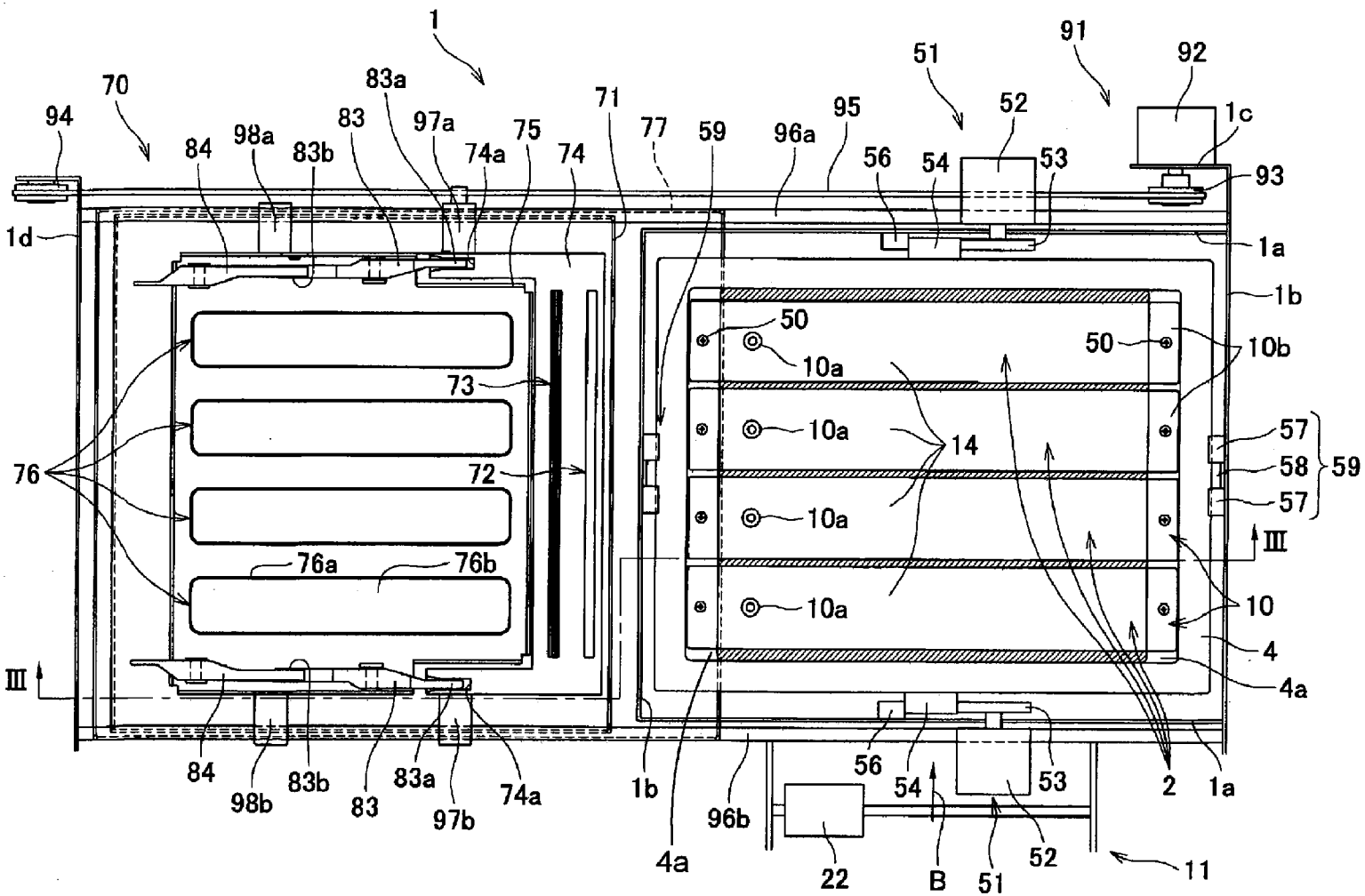
FIG. 2 is a schematic plan view of a main part of the inkjet printer according to an embodiment of the invention.
Figure 3:
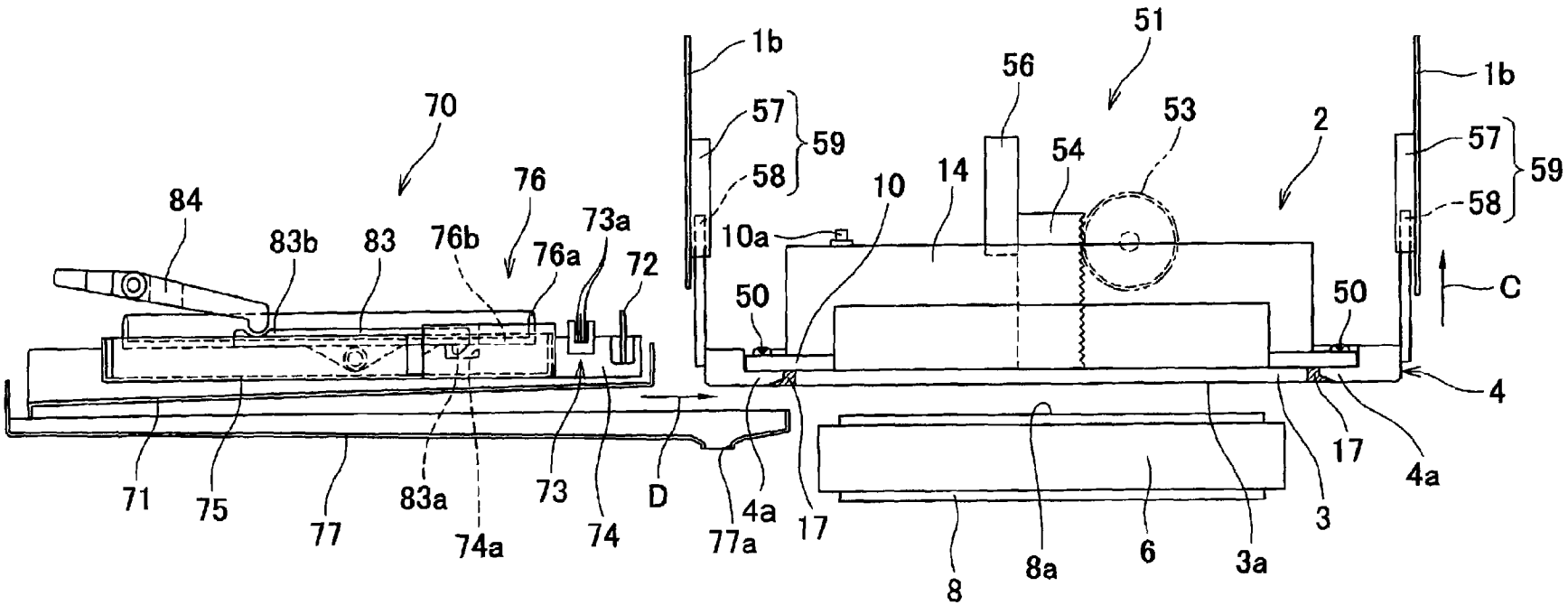
FIG. 3 is a cross-sectional view taken along a line III-III of FIG. 2.

Inkjet printer 1 may be a line-type printer. Inkjet heads 2 may correspond to a plurality, e.g., four, colors of ink, such as magenta, yellow, cyan, and black, respectively, and, referring to FIG. 2, may be arranged in a line along sheet feed direction B, e.g., a direction from down to up. As shown in FIG. 2, inkjet heads 2 may be elongated in a direction perpendicular to sheet feed direction B, and may have a substantially rectangular solid shape. Referring now to FIGS. 1 and 3, each inkjet head 2 may include a head body 3 on a bottom end. Head body 3 may be a laminated body, in which a flow path unit and actuators may be bonded. The flow path unit may be formed with ink paths, including pressure chambers, and the actuators may be configured to apply pressure to ink in the pressure chambers.

Figure 4A:
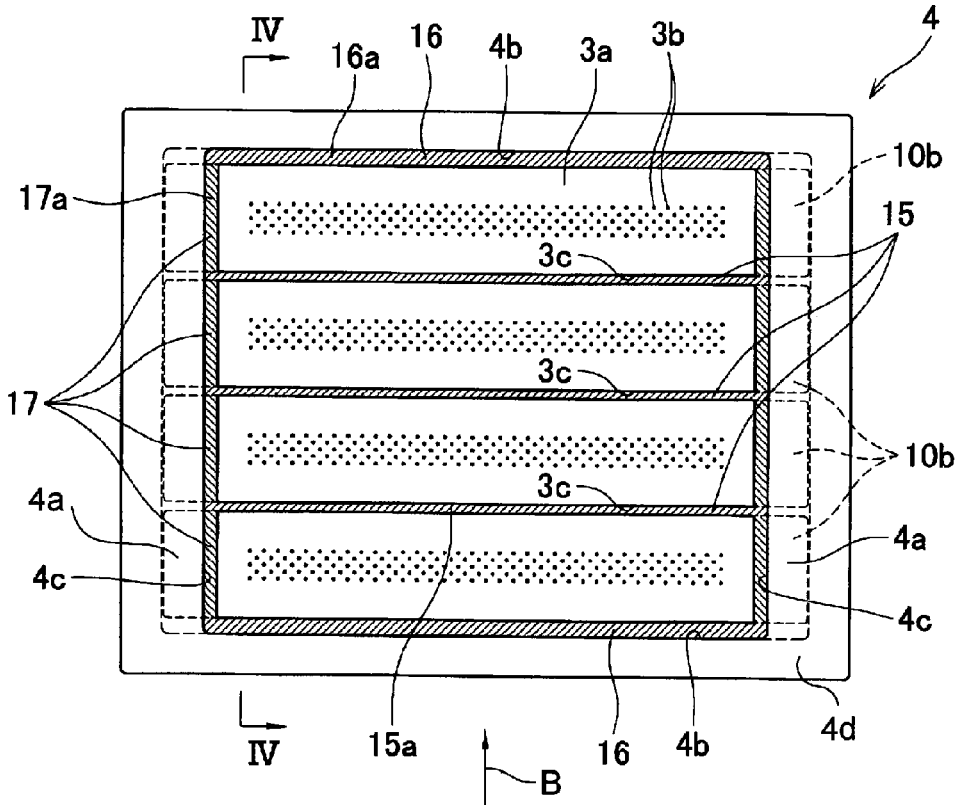
FIG. 4A is a bottom view of four inkjet heads.

A reservoir unit 10 may be fixed to an upper surface of each head body 3. Reservoir unit 10 may be partially covered by a cover 14 and may be configured to temporarily store ink. Reservoir unit 10 may be connected to a tube joint 10*a* fixed to an upper surface of the cover 14. An ink reservoir that may store ink supplied from the tube joint 10*a* may be formed inside. As shown in FIG. 4A, a number of liquid ejection ports, e.g., minute diameter nozzles 3*b*, may be arranged on a bottom surface of each head body 3. The bottom surface may be an ink ejection surface, e.g., liquid ejection surface 3*a*, and may face feeding surface 8*a*. Each reservoir unit 10 may be formed longer than head body 3, with respect to the direction perpendicular to sheet feed direction B. Each reservoir unit 10 may include head fixing portions 10*b* extending toward both ends of head body 3 in the longitudinal direction. Head fixing portions 10*b* may be designed to fix reservoir unit 10 to a frame 4. Ink in the reservoir unit 10 may be supplied to an ink flow path (not shown) of head body 3.

Head body 3 may be disposed such that ink ejection surface 3*a* is parallel to feeding surface 3*a* of conveyor belt 8, and such that there may be a small gap between ink ejection surface 3*a* and feeding surface 8*a*. The gap may be part of the sheet feed path. With this structure, when the recording sheet fed on conveyor belt 8 passes directly under head bodies 3, each color of ink is ejected from nozzles 3*b* toward an upper surface, or a print surface, of the recording sheet, thereby forming a desired color image on the recording sheet.

Referring to FIG. 2, inkjet heads 2 may be arranged adjacently along sheet feed direction B, and may be fixed by frame 4. Referring again to FIGS. 3 and 4, frame 4 may include supporting portions 4*a* extending outward to face head fixing portions 10*b* of reservoir unit 10. Supporting portions 4*a* and head fixing portions 10*b* of reservoir unit 10 may be fixed by screws 50. In this manner, inkjet heads 2 may be enclosed by and fixed to the frame 4. In an embodiment, a surrounding surface, e.g., lower surface 4*d* of frame 4 may be disposed on an imaginary plane extending along ink ejection surfaces 3*a*. In other words, ink ejection surfaces 3*a* of inkjet heads 2 may be disposed substantially level, or coplanar, with lower surface 4*d* of frame 4. Ink ejection surfaces 3*a* also may be exposed from the opening of frame 4, as shown in FIG. 3.

Figure 4B:
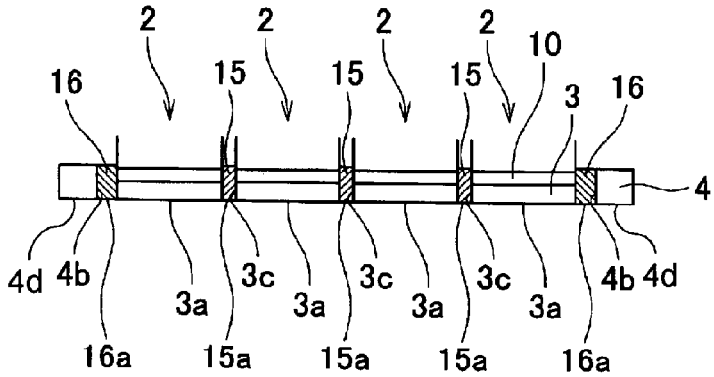
FIG. 4B is a cross-sectional view taken along a line IV-IV of FIG. 4A.

As shown in FIGS. 4A and 4B, minute gaps 3*c* may be formed among the ink ejection surfaces 3*a* in frame 4. Gaps 3*c* may be filled with sealing members 15. Sealing members 15 may be disposed so that surface 15*a* of sealing member 15 may be flush with inkjet ejection surfaces 3*a*, and surface 15*a* may be in the same plane as inkjet ejection surfaces 3*a*. Thus, inkjet ejection surfaces 3*a* may be smoothly wiped by wiper 72.

Minute gaps 4*b* may be formed between the inkjet ejection surfaces 3*a* at each end of frame 4, in sheet feed direction B, and lower surface 4*d* of frame 4, extending along the longitudinal direction thereof. Gaps 4*b* may be filled with further sealing members, e.g., sealing members 16. Minute gaps 4*c* may be formed between ink ejection surfaces 3*a* and supporting portions 4*a*. Gaps 4*c* may be filled with further sealing members, e.g., sealing members 17. Sealing members 16, 17 may be disposed so that farther surfaces 16*a*, 17*a*, of sealing members 16, 17, may be flush with the inkjet ejection surfaces 3*a* and lower surface 4*d* of frame 4, and further surfaces 16*a*, 17*a*, may be in the same plane as inkjet ejection surfaces 3*a* and lower surface 4*d* of frame 4.

In this manner, sealing members 15, 16, 17 may be disposed in all gaps 3*c*, 4*b*, 4*c*, existing between lower surface 4*d* of frame 4 and ink ejection surfaces 3*a*, and among ink ejection surfaces 3*a*. Thus, all gaps 3*c*, 4*b*, 4*c* formed between frame 4 and the lower end of head bodies 3, comprised of four inkjet heads 2, may be filled, and therefore, removed.

In an embodiment, sealing members 15, 16, 17, may be made of a wax, e.g., a wax manufactured by Nikka Seiko. Co. Ltd., and may be melted by heating the wax to a temperature of greater than or equal to a temperature at which the wax hardens. In an embodiment of the invention, the wax hardens at temperatures under 40° C. In an embodiment, if inkjet head 2 is out of order, it easily may be replaced with a new inkjet head by melting sealing members 15, 16, 17. In an embodiment of the invention, sealing members 15, 16, and 17 do not melt under 40° C. Even if the temperature in inkjet printer 1 rises, the temperature rarely exceeds 40° C., thus the way may not melt during the use of inkjet printer 1. In another embodiment, the wax may be liquid at room temperature, and may become solidified when an agent, e.g., an organic agent, included in the wax, is volatilized in air. In yet another embodiment, the wax may always be solid at room temperature Wax in the form of a liquid may be filled in a gap using a dispenser. Wax in the form of a solid may be filled in a gap by melting, e.g. by using a heat gun. In an embodiment, sealing members 15, 16, 17, may be formed of the same material. In another embodiment, sealing members 15, and sealing members 16, 17, may be formed of different materials.

In an embodiment of the invention, the wax melts between 40° C. and 70° C. For example, when one inkjet head 2 is removed from the frame 4 due to malfunction, the wax may not be heated to greater than or equal to 70° C. Thus, by maintaining a temperature lower than 70° C. electronic components mounted on other inkjet heads 2 have a lower likelihood of failure due to thermal effects. Alternatively, if only the wax surrounding the inkjet head to be replaced is heated, the wax may melt when heated to greater than or equal to 70° C. In this case, heat effect may occur only in electronic parts mounted on the inkjet head to be replaced, and electronic parts mounted on the other inkjet heads may not be affected. Sealing members 15, 16, 17 may be made of different materials, as long as the material melts when heated to greater than or equal to 40° C.

Referring again to FIGS. 2 and 3, frame 4 may be supported by a pair of frame moving mechanisms 51 provided in printer 1, so as to move vertically when the frame is positioned as shown in FIGS. 2 and 3. Frame moving mechanisms 51 may be disposed outside inkjet heads 2, as shown in FIG. 2. Each frame moving mechanism 51 may include a drive motor 52 as a drive source to move frame 4 vertically, a pinion gear 53 fixed to a shaft of drive motor 52, a rack gear 54 disposed uprightly in frame 4, and configured to mesh with pinion gear 53, and a guide 56 disposed in a position to hold rack gear 54 with pinion gear 53. Two drive motors 52 may be disposed facing each other, in sheet feed direction B, and fixed to body frame 1*a* of inkjet printer 1. Two rack gears 54 may extend vertically, and may be fixed to the periphery of frame 4 at the lower ends of rack gears 54. Rack gears 54 may slidingly contact guides 56, on an opposite side from pinion gears 53, and guides 56 may be fixed to the body frame 1*a*. In an embodiment, two drive motors 52 may be synchronized with each other, so as to rotate pinion gears 53 in either a normal or a reverse direction, causing the rack gears 54 move vertically. Along with the vertical movement of rack gears 54, frame 4 and inkjet heads 2 may move vertically.

Guide units 59 may be disposed on both sides of inkjet heads 2 with respect to the longitudinal direction. Each guide unit 59 may include a bar-shaped member 58 positioned between a pair of guides 57. As shown in FIG. 3, in each guide unit 59, pair of guides 57 may extend vertically, and may be fixed to one of body frames 1*b*, facing each other in the direction perpendicular to sheet feed direction B. Bar-shaped member 58 may extend vertically as with the guides 57, and may be fixed to a side of frame 4 and disposed in parallel with body frame 1*b*. Bar-shaped member 58 may be slidingly disposed between pair of guides 57. Guide units 59 may prevent ink ejection surfaces 3*a* of inkjet heads 2 from including with respect to feeding surface 8*a* when frame 4 is moved vertically by frame moving mechanisms 51. In other words, ink ejection surfaces 3*a* may be parallel with opposing feeding surface 8*a* even if frame 4 and inkjet heads 2 are moved vertically by frame moving mechanisms 51. As a result, the accuracy of ink droplets directed toward the recording sheet during printing may be improved.

As shown in FIG. 3, frame 4 may be disposed in a print position in which inkjet heads 2 may eject ink droplets onto the recording sheet. When performing maintenance of inkjet heads 2, frame 4 may be moved by frame moving mechanisms 51 to a head maintenance position, where inkjet heads 2 may be disposed above the print position. In an embodiment, maintenance may be performed when a purging operation to forcibly eject ink from inkjet heads 2 may be performed, ink adhering to ink ejection surface 3*a* may be wiped, and ink ejection surfaces 3*a* may be covered with a cap. Maintenance unit 70, configured to perform maintenance on inkjet heads 2, may be disposed on the left of inkjet heads 2 in inkjet printer 1 when inkjet printer 1 is positioned as shown in FIGS. 2 and 3. Referring again to FIG. 3, maintenance unit 70 may include two trays 71, 75, that may be horizontally movable. The tray 71 may have a substantially rectangular box shape, may open upward, and may be configured to hold tray 75 therein. Trays 71, 75 may be coupled to each other via engaging devices, and may be configured to be coupled to and removed from each other as needed, e.g., for maintenance.

As shown in FIG. 3, tray 71 may be open at a side surface opposite from the surface that inkjet heads 2 face. During purging operation, for example, tray 71 may be movable only with tray 75, held in tray 71, remaining. Regardless of an engagement condition of the engaging unit, frame 4 may move upward, e.g., in a direction shown by arrow C in FIG. 3, to the head maintenance position, so that a space for maintenance unit 70 may be provided between ink ejection surfaces 3*a* and feeding surface 8*a*, when maintenance unit 70 moves horizontally. After frame 4 moves upward, maintenance unit 70 may move horizontally, e.g., in a direction shown by arrow D in FIG. 3.

A waste ink receiving tray 77 may be disposed directly under maintenance unit 70. Waste ink receiving tray 77 may have a size larger than tray 71 in a plan view, and may have a shape which allows ink receiving tray 77 to overlap an end portion of tray 71, opposite inkjet heads 2, even when tray 71 moves to the right end of the inkjet printer, when the inkjet printer is positioned as shown in FIG. 2. Waste ink receiving tray 77 may be formed with an ink discharge hole 77*a* at an end close to inkjet heads 2. Ink discharge hole 77*a* may pass through the bottom surface of waste ink receiving tray 77. Ink discharge hole 77*a* may allow ink flowing into waste ink receiving tray 77 to flow into a waste ink reservoir (not shown).

Tray 71 may include a wiper 72, an ink receiving member 73, and tray 75. Wiper 72, ink receiving member 73, and tray 75 may be positioned inside tray 71, and may be arranged in order, beginning closest to inkjet heads 2, which may be disposed in parallel with sheet feed direction B. Tray 75 may include inside a plurality, of caps 76, e.g., four caps 76. Referring to FIG. 2, each cap 76 may have a rectangular plane shape. Referring again to FIG. 3, caps 76 may be arranged in association with ink ejection surfaces 3*a* of inkjet heads 2. Caps 76 may be disposed in parallel to inkjet heads 2 with respect to the longitudinal direction, and at the same intervals of inkjet heads 2 in sheet feed direction B. Each cap 76 may have an annular protrusion 76*a* protruding upward from a bottom portion 76*b*. Each cap 76 may be recessed, and may create a hermetically sealed space when annular protrusion 76*a* contacts corresponding ink ejection surface 3*a*.

Caps 76 may be capable of covering ink ejection surfaces 3*a* in this manner, thus preventing the drying of ink in the nozzles. Caps 76 may be made of an elastic material, e.g., rubber. Thus, ink ejection surfaces 3*a*, and annular protrusions 76*a*, easily may adhere to each other. This adhesion may allow each cap 76 and corresponding ink ejection surface 3*a*, to maintain air tightness in an area enclosed by cap 76 and corresponding ink ejection surface 3*a*. In addition, the ink ejection surfaces 3*a* may be prevented from damage.

Figure 6A:
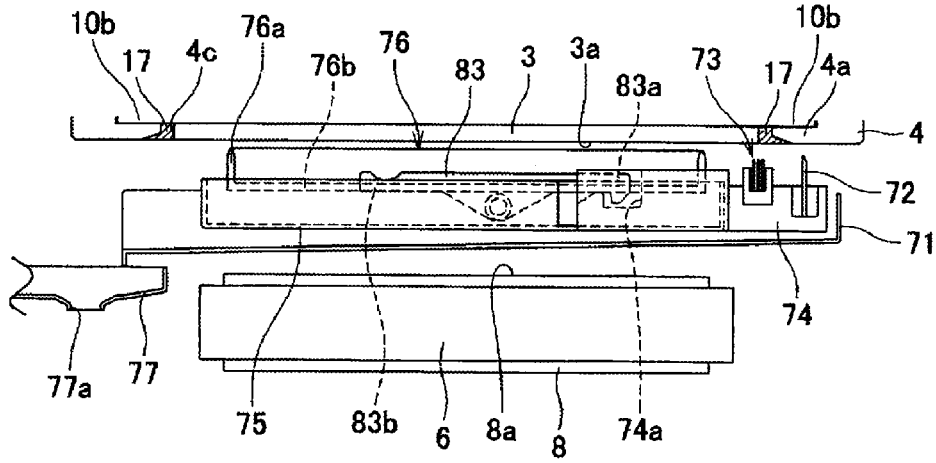
FIG. 6A illustrates that the maintenance unit moves to the maintenance position.
Figure 6B:
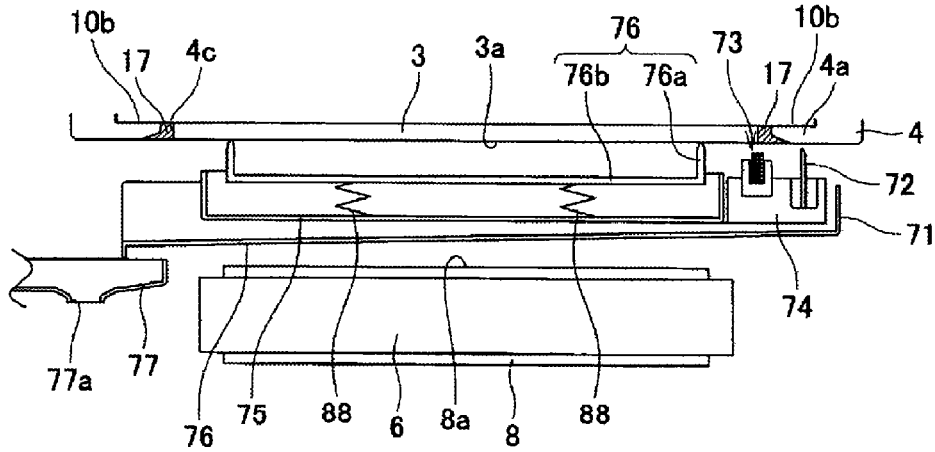
FIG. 6B illustrates that an annular protrusion of a cap is in contact with the ink ejection surface.

As shown in FIG. 6B, each cap 76 may be supported at the bottom surface of tray 75 and may be urged upward by a plurality of, e.g., two, springs 88. Springs 88 may reduce an impactive force generated when annular protrusion 76*a* of cap 76 contacts ink ejection surface 3*a*. Springs 88 also may elastically hold cap 76 and ink ejection surface 3*a* by causing annular protrusion 76*a* of cap 76 to contact ink ejection surface 3*a*. Even if ink ejection surface 3*a* and cap 76 are not aligned exactly parallel, the cap 76 may be capable of conforming with the inclination of ink ejection surface 3*a*. As a result, the area enclosed by cap 76 and ink ejection surface 3*a* may be hermitically sealed.

Referring again to FIG. 2, a holding member 74 may be fixed to tray 71 at an end closest to inkjet heads 2, and may have a square bracket shape when viewed in a plan view. Wiper 72 and ink receiving member 73 may be held in holding member 74, along sheet feed direction B. Engaging, portions, e.g., recessed portion 74*a*, may be formed on ends of holding member 74, extending in the direction perpendicular to sheet feed direction B.

As shown in FIGS. 2 and 3, ink receiving member 73 may have thin plates 73*a*, that may be slightly longer than a total of the widths of four arranged inkjet heads 2. Thin plates 73*a* may be disposed in parallel to each other, at intervals which permit a capillary action of ink to occur. As with thin plates 73*a*, wiper 72 also may be slightly longer than a total of the widths of four arranged inkjet heads 2, and may be disposed so that its longitudinal direction may be parallel to sheet feed direction B. Wiper 72 may be made of an elastic material, e.g., rubber.

Trays 71, 75 may be coupled to each other via the engaging devices. The engaging devices may be disposed substantially at the top and bottom ends of trays 71, 75, when trays 71, 75 are viewed in a plan view as shown in FIG. 2. The engaging devices may include recessed portions 74 provided in holding member 74, and hook members 83 rotatably supported by tray 75. Hook members 83 may extend in the direction perpendicular to sheet feed direction B, and may be rotatably supported substantially at their center. Each hook member 83 may include a hook portion 83*a* at an end of hook member 83 closest to the inkjet heads 2. Hook portion 83*a* may be configured to engage corresponding recessed portion 74*a*. Contact members 84 may be rotatably supported by maintenance unit 70. Contact members 84 may be configured to contact ends 83*b* of hook member 83 located furthest front inkjet heads 2. When contact members 84 rotate in contact with ends 83*b*, hook portions 83*a* may be disengaged from recessed portions 74*a*. When contact members 84 separate from ends 83*b*, hook portions 83*a* may be engaged with recessed portions 74*a*, as shown in FIG. 3.

When maintenance is not performed, maintenance unit 70 may stand still at a withdrawal position, which may be far from inkjet heads 2, as shown in FIGS. 2 and 3, e.g., in FIG. 21 the left side, including maintenance unit 70, does not face inkjet heads 2. When maintenance may be performed, maintenance unit 70 may move horizontally from the withdrawal position to a maintenance position. At the maintenance position, maintenance unit 70 may face ink ejection surfaces 3*a* of inkjet heads 2. At this time, as inkjet heads 2 are located in the maintenance position, wiper 72, and the tips of annular protrusions 76*a* may not contact ink ejection surfaces 3*a*. Ink receiving member 73 may be designed to provide a small gap, e.g., 0.5 mm, between ink receiving member 73 and ink ejection surfaces 3*a*, with wiper 72 in contact with ink ejection surfaces 3*a*.

In maintenance, for example, during a purging operation, tray 75 may be left at the withdrawal position, and tray 71 may be moved under the inkjet heads 2 from the withdrawal position to receive discharged ink. When ink ejection surfaces 3*a* may be covered with caps 76, trays 71, 75 may be coupled to each other via the engaging devices, and may be moved to the maintenance position. Trays 71, 75 may be movably supported by a pair of guide shafts 96*a*, 96*b* extending in the direction perpendicular to sheet feed direction B, as shown in FIG. 2. Tray 71 may be provided with two bearing members 97*a*, 97*b* that protrude from the top and bottom sides of holding member 74. Tray 75 may be provided with two bearing members 98*a*, 98*b* that may protrude from the top and bottom sides of tray 75. Guide shafts 96*a*, 96*b* may be fixed to body frames 1*b*, 1*d*, at their ends, respectively, and disposed in parallel to each other between frames 1*b*, 1*d*. In an embodiment, guide shafts 96*a*, 96*b* may be fixed by a fastening member, e.g., screws. With this configuration, trays 71, 75 may be moved along guide shafts 96*a*, 96*b* leftward, in an arrow direction D, as shown in FIG. 3.

A horizontal moving mechanism 91 may be configured to move trays 71, 75 horizontally. As shown in FIG. 2, horizontal moving mechanism 91 may include a motor 92, a motor pulley 93, an idle pulley 94, a timing belt 95, and guide shafts 96*a*, 96*b*. Motor 92 may be fixed, e.g. attached to an attaching part 1*c* formed at an end of body frame 1*b* extending parallel to sheet feed direction B. Motor pulley 93 may be connected to motor 92, and may rotate along with the drive of motor 92. Idle pulley 94 may be rotatably supported by body frame 1*d*, located on the left side when inkjet printer 1 is positioned as shown in FIG. 2. Timing belt 95 may be disposed in parallel to guide shaft 96*a*, and may be stretched between motor pulley 93 and idle pulley 94. Timing pulley 95 may be coupled to bearing member 97*a*, provided in holding member 74.

With this configuration, when motor 92 may be driven, motor pulley 93 may rotate in a normal or reverse direction, and timing belt 95 may run accordingly. Tray 71 may be connected to timing belt 95 via bearing member 97*a*, and may be moved to the withdrawal position or the maintenance position, e.g., to the left or to the right, respectively, when inkjet printer 1 is positioned as shown in FIG. 2. When hook portions 83*a* are engaged in recessed portions 74*a* of holding member 74, wiper 72 and ink receiving member 73 provided in tray 71, and caps 76 disposed in tray 75 may be moved together to the withdrawal position or to the maintenance position. When hook portions 83*a* are disengaged from recessed portions 74*a*, wiper 72 and ink receiving member 74 disposed in tray 71 may be moved to the withdrawal position or to the maintenance position.

Operations of the maintenance unit 70 will be described with reference to FIGS. 5A, 5B, 6A and 6B. When a purging operation is performed to restore inkjet head 2 when inkjet head 2 has an ejection problem, frame 4 may be moved upward by frame moving mechanisms 51. At this time, two drive motors 52 may be synchronized with each other so as to rotate pinion gears 53 in the normal direction, e.g., clockwise when pinion gears are arranged as shown in FIG. 3. Along the rotation of pinion gears 53, rack gears 54 may move upward. Frame 4, which may be fixed to rack gears 54, may move upward, along with inkjet heads 2. When frame 4 and inkjet heads 2 arrive at the maintenance position, drive motors 52 may be stopped, thus providing a space for disposing maintenance unit 70 between ink ejection surfaces 3*a* and conveyor belt 8. Thus, ink ejection surfaces 3*a* of inkjet heads 2 in the maintenance position and the bottom surface of frame 4 may be located at positions which do not contact wiper 72 and the tips of annular protrusions 76*a* when maintenance unit 70 is moved to the maintenance position.

Figure 5A:
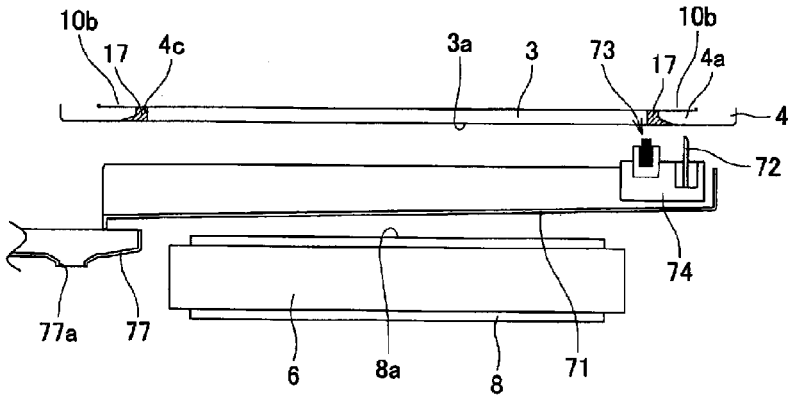
FIG. 5A illustrates that the inkjet head moves from a printing position to a head maintenance position and a tray of a maintenance unit moves to a maintenance position.

Contact members 84 may be brought into contact with ends 83*b* of hook members 83, so that hook portions 83*a* may be disengaged from recessed portions 74*a*, uncoupling trays 71, 75. With trays 71, 75 uncoupled, motor 92 of horizontal moving mechanism 91 drives timing belt 95, and the running of timing belt 95 causes tray 71 to move to the maintenance position. When tray 71 arrives at the maintenance position, as shown in FIG. 5A, motor 92 may be stopped. A pump (not shown) to force ink in the ink tank (not shown) to flow into inkjet heads 2 may be driven to perform a purging operation, for ejecting ink from nozzles 3*b* of inkjet heads 2 to tray 71. Due to the purging operation, ejection problems at nozzles 3*b*, such as clogging, and increased viscosity of ink may be solved. Ink purged into tray 71 may move along the bottom surface of the tray 71, e.g., in a leftward direction when tray 71 is positioned as shown in FIG. 5A, and may flow into waste ink receiving tray 77. The purged ink may be discharged from ink discharge hole 77*a* of waste ink receiving tray 77, but the purged ink may partially remain on ink ejection surfaces 3*a*, in the form of ink droplets.

Figure 5B:
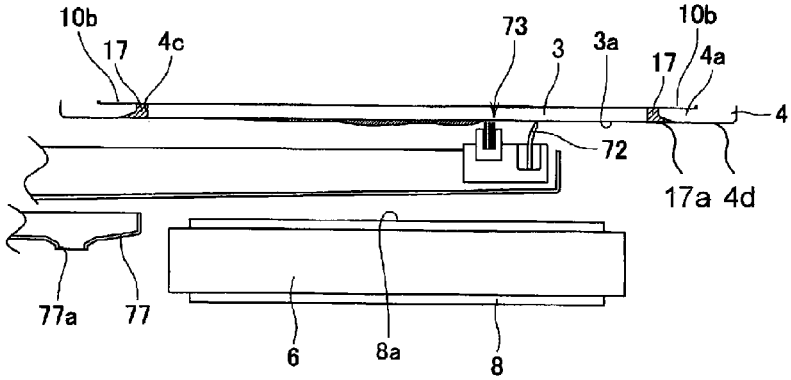
FIG. 5B illustrates that ink adhering to an ink ejection surface is wiped by an ink receiving member and a wiper.

Inkjet heads 2 may be moved downward by frame moving mechanisms 51. When tray 71 may be moved to the withdrawal position, e.g., leftward when tray 71 is positioned as shown in FIG. 5, inkjet heads 2 may be located in positions where the upper end of wiper 72 is capable of contacting ink ejection surfaces 3*a* and lower surface 4*d* of frame 4, e.g., a 0.5 mm gap may be formed between ink ejection surfaces 3*a* and thin plates 73*a* of ink receiving member 73. As shown in FIG. 5B, tray 71 may be moved leftward, i.e., moved from the maintenance position to the withdrawal position, by horizontal moving mechanism 91, and wiping is performed.

At this time, the upper end of wiper 72 may be located higher than lower surface 4*d* of frame 4. Thus, wiper 72 may contact lower surface 4*d* of frame 4 and ink ejection surfaces 3*a* while being bent, and wiper 72 may wipe the purged ink adhering to ink ejection surfaces 3*a*. The upper ends of thin plates 73*a* of ink receiving member 73 may be located in proximity to ink ejection surfaces 3*a*, leaving a minute gap. Thus, relatively large ink droplets adhering to ink ejection surfaces 3*a* may move in between thin plates 73*a* of ink receiving member 73 by capillarity action. Even when wiper 72, contacting lower, surface 4*d* of frame 4, passes sealing members 15, 16, 17, wiper 72 can wipe ink ejection surfaces 3*a* smoothly because surfaces 15*a*, 16*a*, 17*a* are disposed coplanar with, e.g., in the same plane as, ink ejection surfaces 3*a* and lower surface 4*d* of frame 4. As sealing members 16, 17 may be disposed between frame 4 and ink ejection surfaces 3*a*, when wiper 72 moves from frame 4 to ink ejection surfaces 3*a*, wiper 72 does not contact a corner of head body 3, thus reducing the likelihood of damage to wiper 72.

The inkjet heads 2 having ink ejection problems may be restored by purging, and ink adhering to the ink ejection surfaces 3*a* may be wiped. In this manner, maintenance may be finished. As lower surface 4*d* of frame 4 may be level with ink ejection surfaces 3*a*, wiper 72 may wipes lower surface 4*d* of frame 4 in addition to ink ejection surfaces 3*a*, while tray 71 is moved to the withdrawal position.

While printer 1 may be out of action for a prolonged period of time in which printing onto recording sheets is not performed, ink ejection surfaces 3*a* may be covered with caps 76.

Similarly to the above description, inkjet heads 2 may be moved from the print position to the maintenance position by frame moving mechanisms 51. As shown in FIG. 6A, trays 71, 75 may be moved to the maintenance position by horizontal moving mechanism 91, with trays 71, 75 coupled via hook members 83. At this time, annular protrusion 76*a* of each cap 76 may be disposed facing a circumference of an area where nozzles 3*b* may be formed on corresponding ink ejection surface 3*a*. Referring now to FIG. 6B, teach inkjet head 2 may be moved downward by frame moving mechanisms 51, so that the top of annular protrusion 76*a* may be brought into contact with ink ejection surface 3*a*, allowing ink ejection surface 3*a* to be hermetically sealed by cap 76, to prevent drying of ink in nozzles 3*b*.

According to inkjet printer 1 of an embodiment, as sealing members 15 may be filled in minute gaps 3*c* formed between ink ejection surfaces 3*a*, foreign matters, e.g., ink wiped from ink ejection surfaces 3*a* by wiper 72, ink mist in air, and dust, may be prevented from entering gaps 3*c*. If gaps 3*c* are not filled with sealing members 15, ink may enter gaps 3*c*, fall down from gaps 3*c* to the recording sheet, and smudge the recording sheet, or ink may be scraped out from gaps 3*c* by wiper 72 and adhere to ink ejection surfaces 3*a*. However, sealing members 15 may reduce the likelihood of these events occurring.

According to an embodiment, sealing members 15, 16, 17 may be made of wax. However, in other embodiments, sealing members 15, 16, 17 may be made of adhesive and structural members made of resin may be fitted in the gaps 3*c* instead. In other words; frame 4 and sealing members 16, 17 may be omitted. If inkjet heads 2 are directly fixed to the printer body, any objects that can fill the gaps to prevent foreign matters may be disposed between ink ejection surfaces 3*a* of inkjet heads 2. Sealing members 15, 16, 17 may not be level with ink ejection surfaces 3*a*.

The above embodiment is an example of the invention that may be applied to an inkjet printer having inkjet heads configured to eject ink from nozzles. However, the invention is not limited to embodiments containing inkjet heads. The invention may be applied to various kinds of liquid jetting apparatuses, having a plurality of liquid jetting heads for multiple applications, e.g., forming fine wiring patterns on a substrate by ejecting conductive paste, making a high-definition display by ejecting organic light emitting member on a substrate, or forming microelectronic devices such as optical waveguides by ejecting optical plastics on a substrate.

Although embodiments of the invention have been described in detail herein, the scope of the invention is not limited to these embodiments. It will be appreciated by those skilled in the art that various modifications may be made without departing from the scope of the invention. Accordingly, the embodiments disclosed herein are merely exemplary, and are not intended to define the scope of the invention. It is to be understood that the scope of the invention is not to be limited thereby, but is to be determined by the claims which follow.

What is claimed is:

1. A liquid ejection apparatus comprising:

a plurality of liquid ejection heads, each liquid ejection head comprising a liquid ejection surface formed with a plurality of nozzles, and wherein a particular gap is formed between the plurality of liquid ejection heads;

a particular wax filled in the particular gap, wherein the particular wax forms a particular surface, and wherein the particular wax joins the liquid ejection surface of at least one of the plurality of liquid ejection heads to an adjacent liquid ejection surface of at least another of the plurality of liquid ejection heads; and a wiper configured to wipe each liquid ejection surface of the plurality of liquid ejection heads and the particular surface.

2. The liquid ejection apparatus according to claim 1, wherein the particular wax has a melting point that is greater than or equal to 40° C. and less than or equal to 70° C.

3. The liquid ejection apparatus according to claim 1, wherein the particular surface is coplanar with the liquid ejection surface of the at least one of the plurality of liquid ejection heads.

4. The liquid ejection apparatus according to claim 1, further comprising:

a frame configured to support the plurality of liquid ejection heads, the frame comprising a surrounding surface surrounding the liquid ejection surface of each of the plurality of liquid ejection heads, wherein a further gap is formed between at least one of the plurality of liquid ejection heads and the frame; and a further wax filled in the further gap, wherein the further wax forms a further surface joining the liquid ejection surface of the at least one of the liquid ejection heads and the surrounding surface, and wherein the wiper is configured to wipe the surrounding surface and the further surface.

5. The liquid ejection apparatus according to claim 4, wherein the particular wax and the further wax comprise a same material.

6. The liquid ejection apparatus according to claim 4, wherein the particular surface, the further surface, at least one liquid ejection surface of the plurality of liquid ejection heads, and the surrounding surface are coplanar with each other.

7. The liquid ejection apparatus according to claim 4, wherein at least one of the plurality of liquid ejection heads is separated from at least another of the plurality of liquid ejection heads and from the frame when the particular wax and the further wax are melted.

8. The liquid ejection apparatus according to claim 1, wherein at least one of the plurality of liquid ejection heads is separated from at least another of the plurality of liquid ejection heads when the particular wax is melted.

9. The liquid ejection apparatus according to claim 1, wherein the plurality of liquid ejection heads comprise a liquid ejection head configured to eject yellow liquid, a liquid ejection head configured to eject magenta liquid, a liquid ejection head configured to eject cyan liquid, and a liquid ejection head configured to eject black liquid.

* * * * *